US007760899B1

(12) United States Patent
Graber

(10) Patent No.: US 7,760,899 B1
(45) Date of Patent: Jul. 20, 2010

(54) SUBWOOFER WITH CASCADED ARRAY OF DRIVERS ARRANGED WITH STAGGERED SPACING

(76) Inventor: Curtis E. Graber, 9301 Roberts Rd., Woodburn, IN (US) 46797

( * ) Notice: Subject to any disclaimer, the term of this patent is extended or adjusted under 35 U.S.C. 154(b) by 1180 days.

(21) Appl. No.: 11/362,933

(22) Filed: Feb. 27, 2006

(51) Int. Cl.
*H04R 1/02* (2006.01)
*H04R 9/06* (2006.01)
*H04R 1/20* (2006.01)

(52) U.S. Cl. ..... 381/341; 381/342; 381/335; 181/152

(58) Field of Classification Search ..... 381/340–343, 381/87, 335–336, 182, 386–387; 181/145, 181/152, 159, 177, 187–188
See application file for complete search history.

(56) References Cited

U.S. PATENT DOCUMENTS 4,138,594 A 2/1979 Klipsch
4,845,759 A * 7/1989 Danley ..... 381/97
5,517,573 A 5/1996 Polk et al.
5,898,138 A 4/1999 Delgado, Jr.
6,118,883 A * 9/2000 Rocha ..... 381/387
6,343,134 B1 * 1/2002 Czerwinski ..... 381/342
6,411,718 B1 * 6/2002 Danley et al. ..... 381/342
6,621,909 B1 * 9/2003 Webb et al. ..... 381/342
6,628,796 B2 * 9/2003 Adamson ..... 381/342
7,134,523 B2 * 11/2006 Engebretson ..... 181/144
7,454,030 B2 * 11/2008 Graber ..... 381/341
2001/0016045 A1 * 8/2001 Ohta ..... 381/98

* cited by examiner

*Primary Examiner*—Xu Mei
(74) *Attorney, Agent, or Firm*—Paul W. O'Malley

(57) ABSTRACT

A single folded, expanding horn loudspeaker reproduces low frequency audible sound at high power output levels. A compact enclosure houses a plurality of identical transducers, characterized by small vibrational surface areas. The throats for each transducer into the horn are acoustically differentially spaced from the mouth of the horn with the spacing between adjacent throats progressively increasing in the acoustic direction of the horn mouth from the throat origin.

15 Claims, 21 Drawing Sheets

26
28
30
32
701
703
705
707
709
DSP
3
2
1
Ø
713
715
717
719
711
AUDIO

1200

61

SUBWOOFER WITH CASCADED ARRAY OF DRIVERS ARRANGED WITH STAGGERED SPACING

BACKGROUND OF THE INVENTION

1. Technical Field

The invention relates to an electro-acoustical device and, more particularly, to a horn loaded loudspeaker for reproducing low frequency audible sound at high power output levels from a plurality of electric-acoustic transducers having relatively small diaphragms and enclosed in a compact, preferably portable, enclosure.

2. Description of the Problem

The reproduction of low frequency audible sound, with high fidelity and at high intensity levels, poses a number of challenges. To do so from a small, energy efficient package, portable enough to be moved and suitable for open air use is especially difficult. Generally, high output, high efficiency, low frequency loudspeakers have been built around a horn. A horn is in effect an acoustic transformer, allowing the designer to obtain the output performance of a larger area diaphragm than that possessed by the acoustic driver. At the same time cone/diaphragm resonance issues that exist with direct radiator devices are minimized. Increasing the effective diaphragm area renders radiation impedance increasingly resistive with the result that increasing power may be absorbed at the desired low frequencies. However, increasing acoustic power output from most horn designs has required increasing diaphragm piston travel in order to move the required volume velocity of air. Piston travel becomes an important limiting factor relating to the amount of power that can be delivered to the horn.

Another limitation on the total energy input that can be introduced to a horn has been the limited scalability of horns. Though examples of multiple driver horns are known, typically only a single driving unit for a given frequency range has been provided. One example of a multiple driver horn (U.S. Pat. No. 5,898,138) positions a pair of low frequency transducers having throats located equidistant from the horn's mouth. While effective, such an arrangement is not readily scalable to a greater number of drivers.

In a prior application by the present inventor for a Subwoofer with Cascaded Linear Array of Drivers, U.S. patent application Ser. No. 10/649,040, filed 27 Aug. 2003, now U.S. Pat. No. 7,454,030, which is incorporated herein by reference, a folded, expanding horn loudspeaker having a selectable plurality of acoustic drivers was disclosed. The loudspeaker unit provided a compact enclosure defining the folded, expanding horn and housing the acoustic drivers. Four identical acoustic drivers were provided, each having a relatively small cone or diaphragm, and each being located in a sealed back chamber (i.e. a closed box baffle). The acoustic drivers radiated into volumetrically identical high pressure chambers located in front of the drivers. Each high pressure front chamber was coupled to a summing throat for the horn by an extended port which operated as an air pressure or air volume velocity step up transformer. The outlets of the ports were acoustically spaced from one another by equal distances and differentially spaced from the mouth of the horn. Transducer drive circuitry applied drive signals to the acoustic transducers derived from a common source. The signal to the respective acoustic transducers was delayed to compensate for the distance of the throats for the respective acoustic transducers from the mouth of the horn. The source signal was also as filtered and phase adjusted as required for clear reproduction of the sound.

SUMMARY OF THE INVENTION

The invention provides a horn loaded loudspeaker having a plurality of acoustic drivers. The number of acoustic drivers is scalable. The horn includes a summing throat which is characterized in that sound energy is introduced to the summing throat at distributed points along the summing throat in the direction of acoustic propagation toward the horn mouth. Spacing between the distributed points progressively increases in the direction of sound propagation. Each acoustic driver is disposed in an enclosure with a back chamber, typically a closed box baffle, although designs ported to a front chamber are possible. Acoustic drivers may be disposed to radiate directly into a summing throat, or into front chambers which are ported to the summing throat, or by passive radiators through a front chamber.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
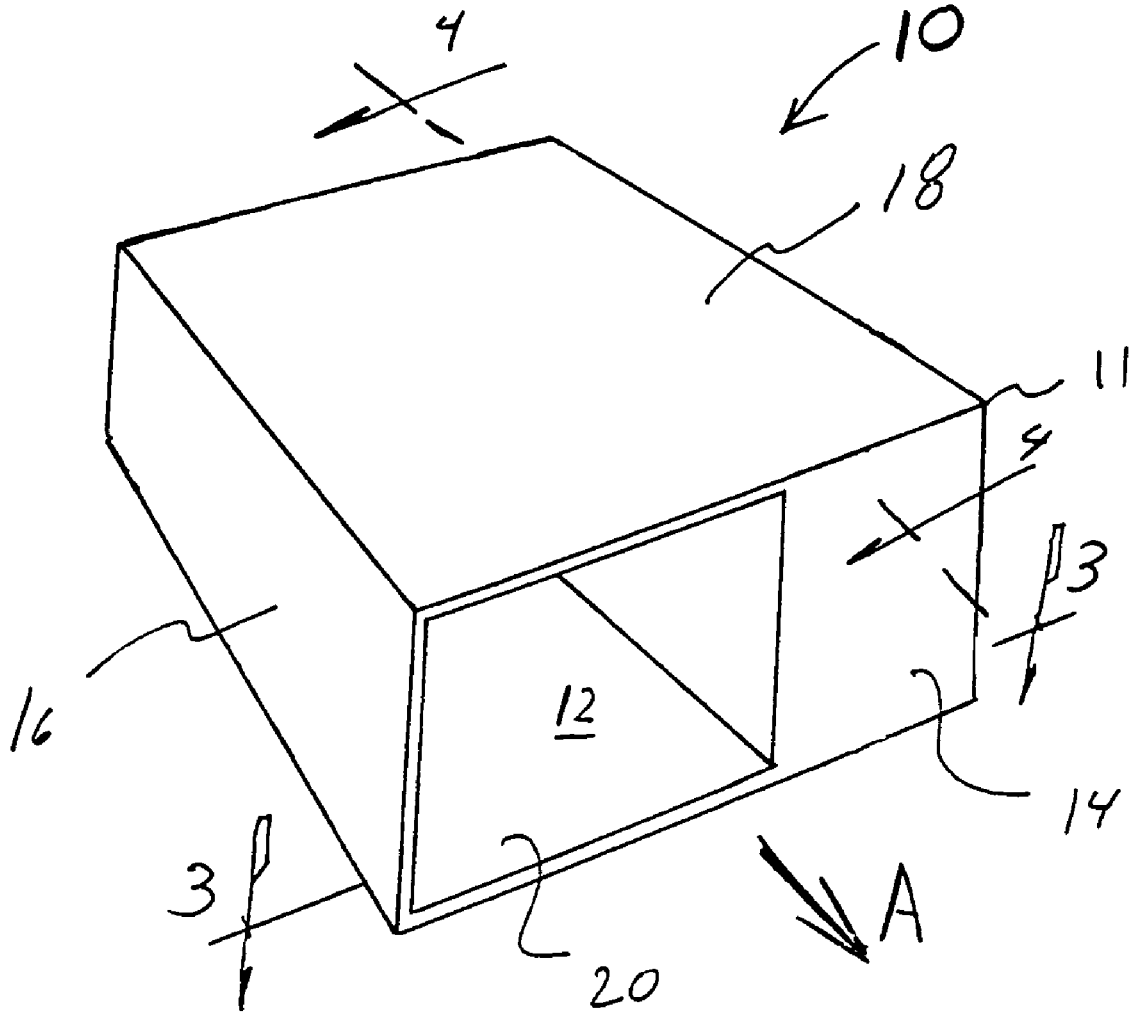
FIG. 1 is a perspective view of a loudspeaker enclosure.

Referring now to the figures and in particular to FIG. 1 there is illustrated a loudspeaker system 10 for use as a high output, transportable unit. Loudspeaker system 10 comprises a right trapezoid enclosure or cabinet 11 which houses sound radiators and a folded waveguide or horn having a mouth 12 in front wall 14. Mouth 12 directs sound radiated from loudspeaker system 10 forward from the unit indicated by the arrow labeled "A". Enclosure 11 is constructed from front wall 14, a back wall, a first side wall 16, a second side wall (described below), a cover 18 and a base 20. The bases and walls are conventionally made of plywood or some other material which does not readily absorb sound.

Figure 2:
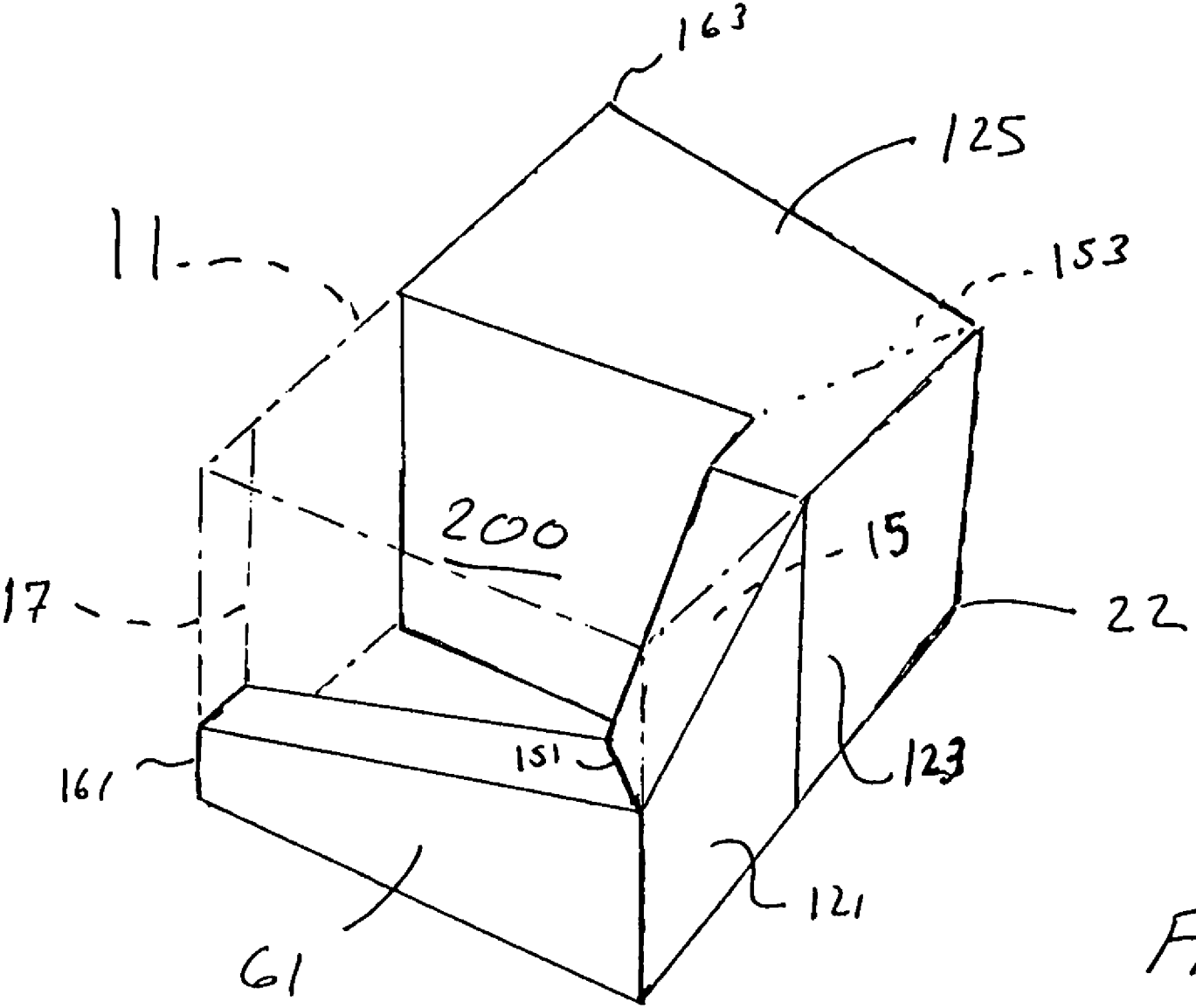
FIG. 2 is a perspective view of the loudspeaker horn.

Referring to FIG. 2, enclosure 11 is presented in phantom at a reverse angle from the view of FIG. 1 with its interior folded horn shown in solid lines. Folded horn 22 is optimized for low frequency applications and is constructed from flat sides and incorporates a flare, as is conventional. Folded horn 22 is disposed along side walls 16, 17 and the back wall 15 of enclosure 11 which form portions of the horns walls. Folded horn 22 expands cross-sectionally along its entire length from a base end 161, adjacent which the horn has its minimum cross-sectional area, to end 163 where the mouth of the horn is located. Folded horn 22 expands initially both vertically and horizontally, but eventually only in the horizontal dimension. A summing throat 61 is disposed along side 17 at the acoustic base of the horn 22 which expands in both the vertical and horizontal directions to a fold 151, where it attaches into a first backside section 121. Backside section 121 continues to expand in two mutually perpendicular directions up to a second backside section 123. Section 123 is characterized by horn 22 having a constant vertical dimension, however expansion continues in the horizontal dimension at a rate consistent with the horn's flare constant. Vertical expansion is stopped in second backside section 123 not for functional reasons, but for external packaging reasons. Section 123 meets the final horn section 125, which continues to expand in the horizontal dimension, along fold 153. Loudspeakers are nestled in the pocket 200 formed by and partially enclosed by the inward oriented sides of the exterior faces of folder horn 22.

Figure 3:
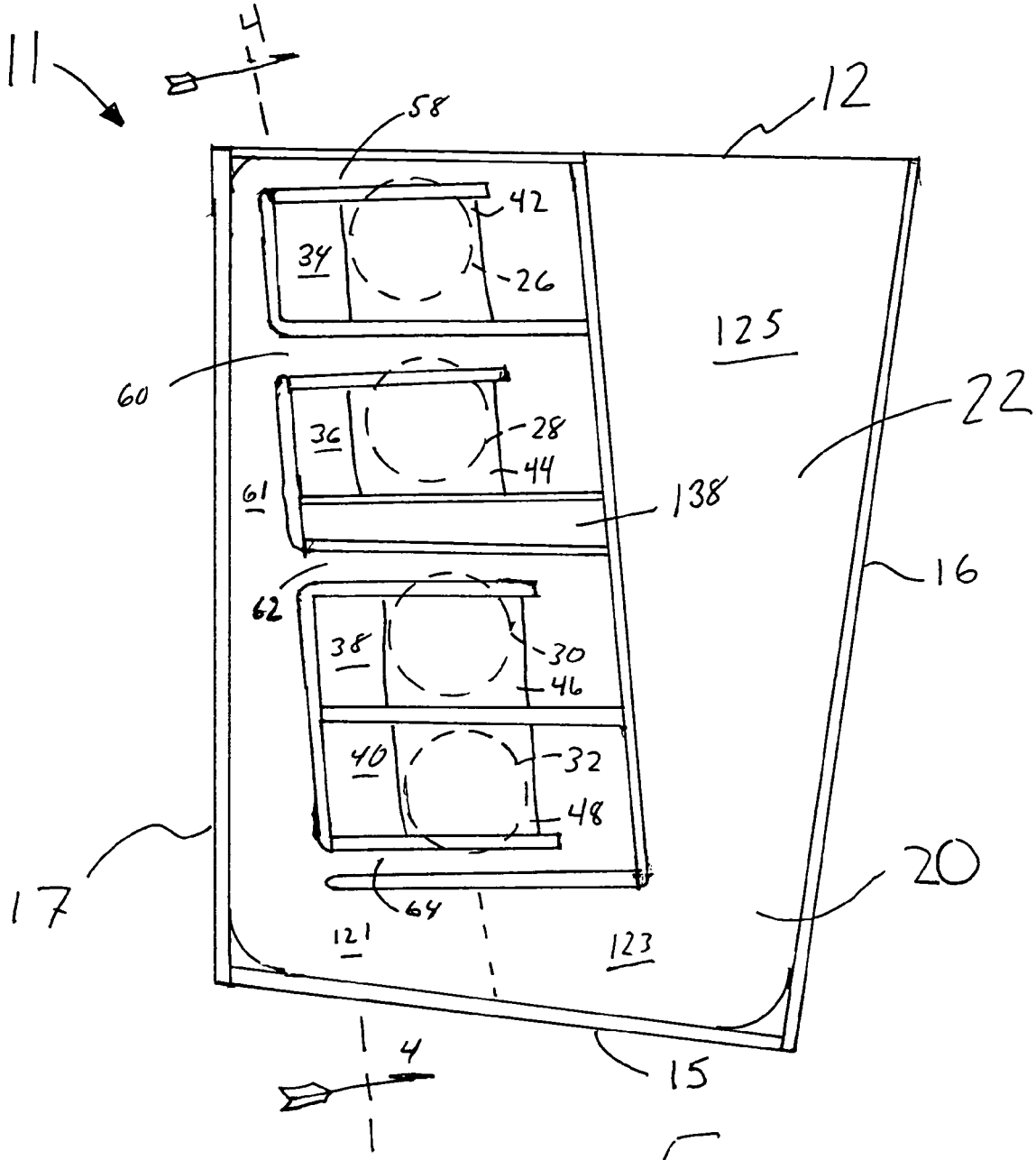
FIG. 3 is a cross sectional view of the loudspeaker enclosure of FIG. 1 taken along section line 3-3.

FIG. 3 is a cross sectional view of enclosure 11 taken along section line 3-3 in FIG. 1. Four walls form the perimeter, exterior sides of enclosure 11 including front wall 14, first side wall 16, back wall 15 and a second side wall 17. The perimeter formed by these walls is broken only by mouth 12 which provides a radiating outlet from the waveguide, i.e. folded, expanding horn 22. Folded horn 22 has a rectangular cross sectional shape and comprises four major sections and two bends or folds. A horn flare is provided by increasing the area of the section with distance through the horn 22. Initially, the cross-sectional dimensions of folded horn 22 increase in both the vertical and horizontal dimensions, but eventually only in the horizontal. Folded horn 22 includes a summing throat 61 into which four ports or extended throats 58, 60, 62 and 64 are directed. Folded horn 22 expands both vertically and horizontally for the entire length of summing throat 61. Folded horn 22 is divided into two sections 121 and 123 along back wall 15 of enclosure 11. Section 121 continues the two dimensional cross sectional expansion of fold horn 22 from summing throat 61. Section 123 expands only horizontally. Running from section 123 to mouth 12 is the final horn section 125, which also expands only in the horizontal direction.

How acoustic transducers/drivers are housed in enclosure 11 and the technique used to couple the output of the transducers into the summing throat 61 can vary substantially. In the illustrated embodiment four acoustic drivers or transducers 26, 28, 30 and 32 are positioned in enclosure 11 (the latitudinal positions of which are illustrated in phantom) and oriented to direct sound downwardly into four high pressure (or preload) chambers 34, 36, 38 and 40 located directly above base 20. The upper surface of base 20 forms the bottom surfaces of high pressure chambers 34, 36, 38 and 40 which are aligned with one another. Acoustically absorbent pads 42, 44, 46 and 48 are positioned on the upper surface of bottom board 20 within each of chambers 34, 36, 38 and 40 to deaden resonance. Pads 42, 44, 46, 48 correspond to and are vertically aligned with acoustic drivers 26, 28, 30, 32, respectively. High pressure chambers 34, 36, 38, 40 each have the same volume as one another and the throats 58, 60, 62 and 64 have the same cross sectional areas as one another.

Next, one method of coupling sound energy via ports into the summing throat 61 is illustrated. High pressure chambers 34, 36, 38 and 40 have acoustic outlet ports formed by extended throats 58, 60, 62 and 64, respectively. Extended throats 58, 60, 62 and 64 direct energy into summing throat 61. The outlets from extended throats 58, 60, 62 and 64 act as diaphragms aligned along one side of the summing throat 61 of folded horn 22.

Each extended throat 58, 60, 62 and 64 has a cross sectional area which is at least 20% of the area of diaphragm for the corresponding acoustic drivers 26, 28, 30 and 32 and 100% of that area of the corresponding diaphragms. Preferably the diaphragms of drivers 26, 28, 30 and 32 are each about 3½ times the area of the cross section of the extended throats. As the diaphragms move back and forth in alternating fashion to form compression waves in the air mass, the air in high pressure chambers 34, 36, 38 and 40 varies in pressure. The extended throats are relatively constricted in area when constructed the preferred ratio and function as pneumatic amplifiers increasing the volume velocity of the air. Accordingly the movement of driver diaphragms can be made much smaller than is the case on the prior art because changes in air pressure in high pressure chambers 34, 36, 38 and 40 are relatively stiff. At the same time, the high pressure compression chambers 34, 36, 38 and 40 absorb much more power per unit of movement of the diaphragm allowing much larger driver motors to be employed. These motors may be two to three times as powerful as is conventional. For maximum power input the driver diaphragms may be pushed at velocities up to the point of destructive turbulence in the extended throats 58, 60, 62 and 64.

A key contribution of the invention lies in selecting the spacing between points of connection between the outlets from the extended throats 58, 60, 62 and 64 into the summing throat 61. The distances between successive adjacent pairs of outlets into the summing throat 61 is progressively increased in the direction of acoustic propagation. Since the outlets are at different distances from mouth 12 and, as a consequence, see different output impedances and there will be different propagation times for the sound energy the acoustic drivers emit to mouth 12. The phase and frequency response of horn 22 will differ with respect to extended throats 58, 60, 62 and 64, sometimes in ways difficult to predict in advance for particular horn parameters and thus empirical evaluation may be required to determine the best dynamic phase adjustments, frequency band widths and roll offs to be used with the drive signal for each of the acoustic drivers 26, 28, 30 and 32. A spacer 138 is disposed between back chambers 82 and 84. Spacer 138 is an element employed in introducing variable, and increasing, spacing between the outlets of extended throats 60 and 62 into the summing throat 61.

Figure 14:
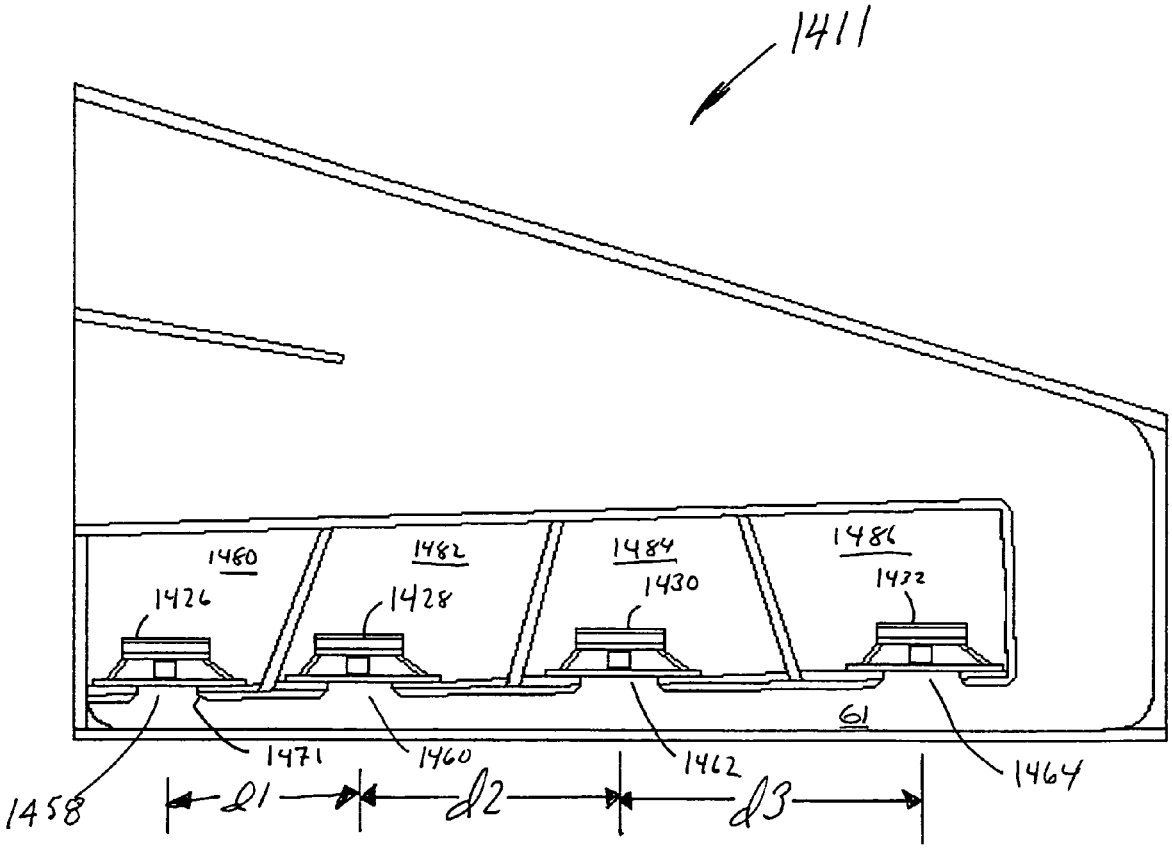
FIGS. 14-18 are cross-sectional views of alternative loudspeakers in accordance with alternative embodiments of the invention.
Figure 15:
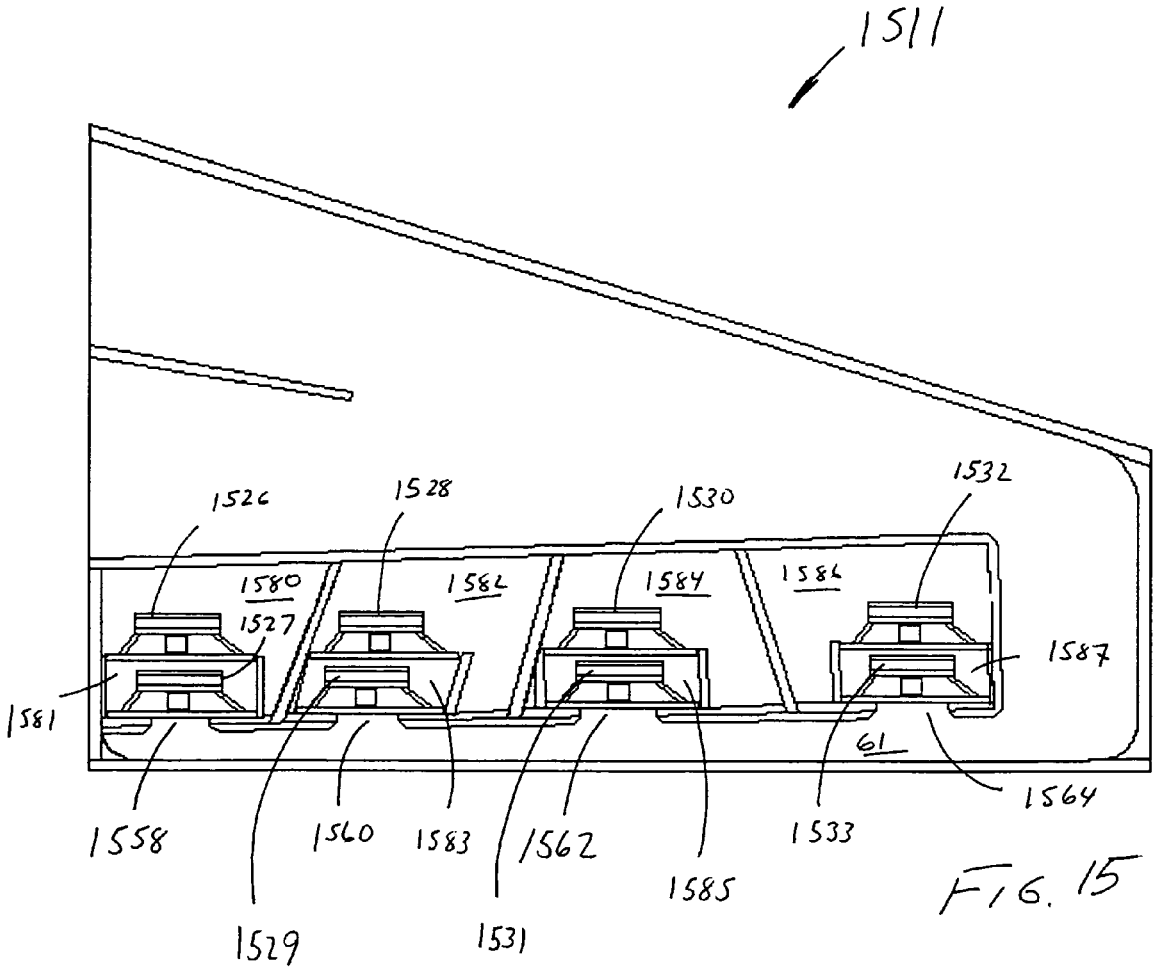
Figure 16:
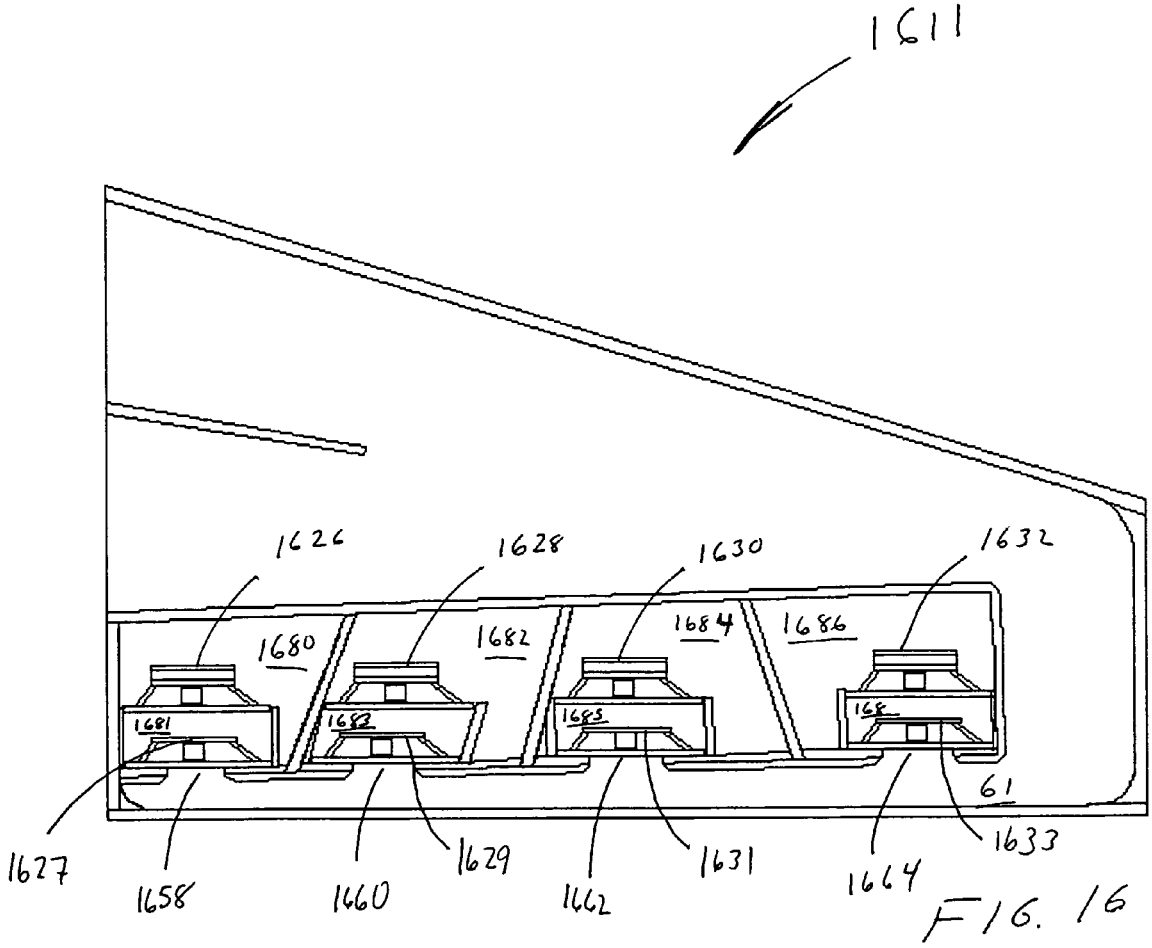
Figure 17:
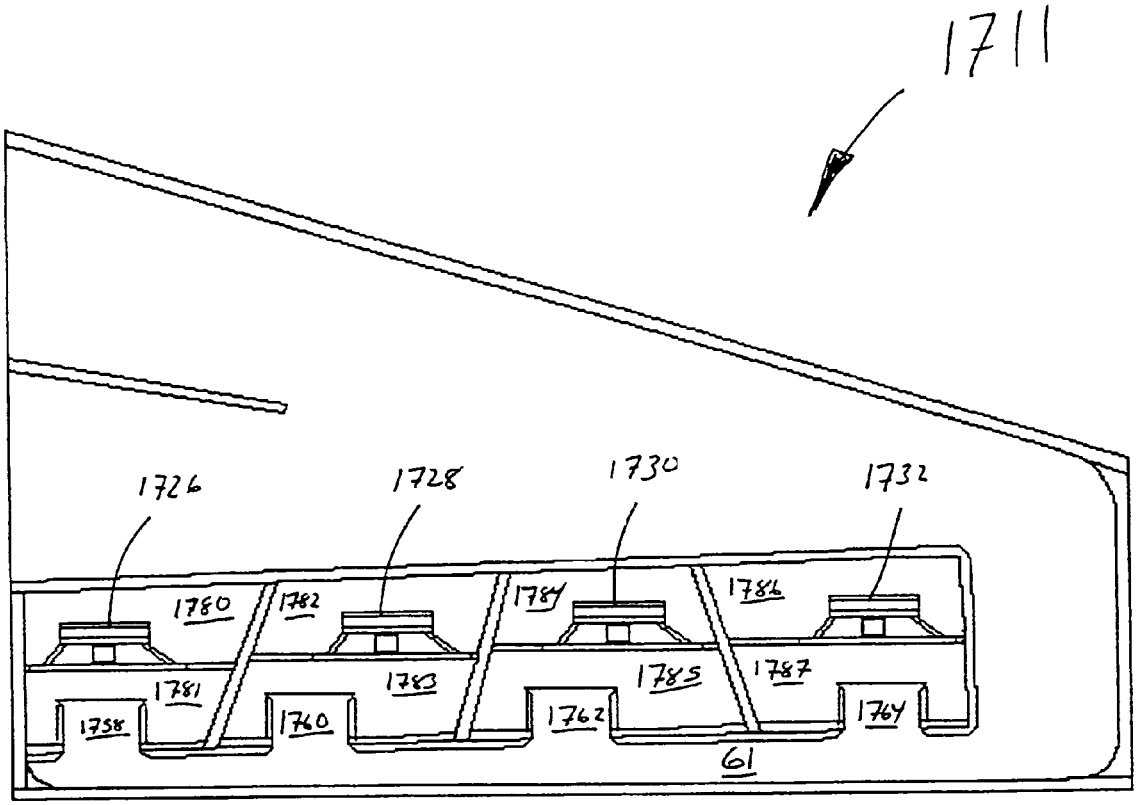
Figure 18:
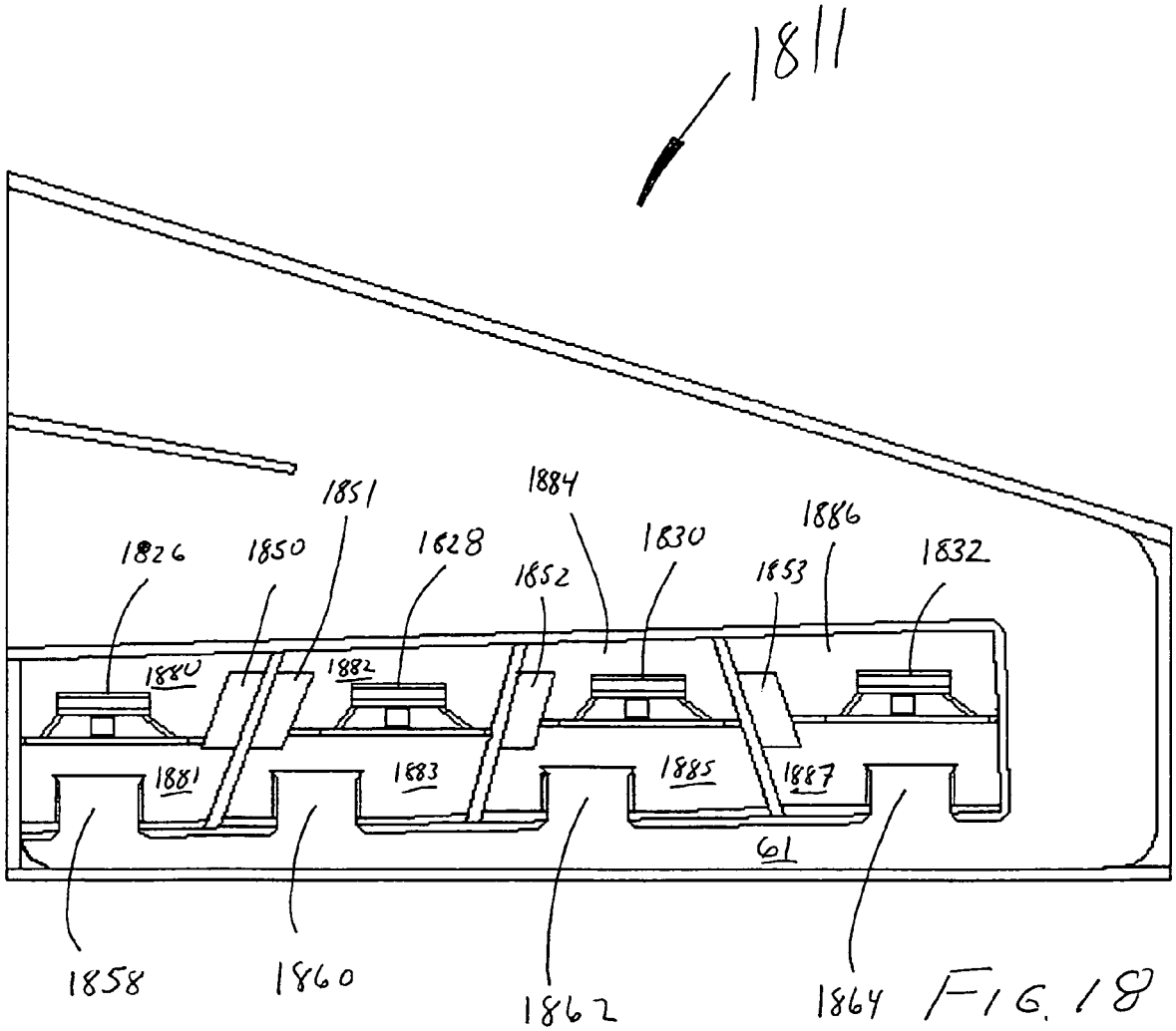

The outlets from the extended throats 58, 60, 62 and 64 into summing throat 61 are not spaced equidistantly from one another (See FIG. 14). From the base of the summing throat 61, which is co-located with the outlet from extended throat/port 58 each successive outlet is spaced by a greater distance from the preceding outlet. System directivity (Q) has been established empirically to improve using either a logarithmic exponential or tractrix expansion of distances over equidistant spacing of the ports. It is believed that the best results will be obtained where the ratio of the distance between the outlets for port 62 and port 60 over the distance between the outlets for port 60 to 58 is 4:3 and the ratio of the distance between outlets from ports 60 and 62 to the distance between outlets for ports 62 and 60 is 3:2. In a loudspeaker intended for bass audio reproduction the spacing between throats 58 and 60 may be set at 24 inches, between throats 60 and 62 at 32 inches and between throats 62 and 64 at 48 inches. The better distance ratios between successive adjacent pairs of outlets may depend upon the expansion function of the horn in the direction of acoustic propagation.

Figure 4:
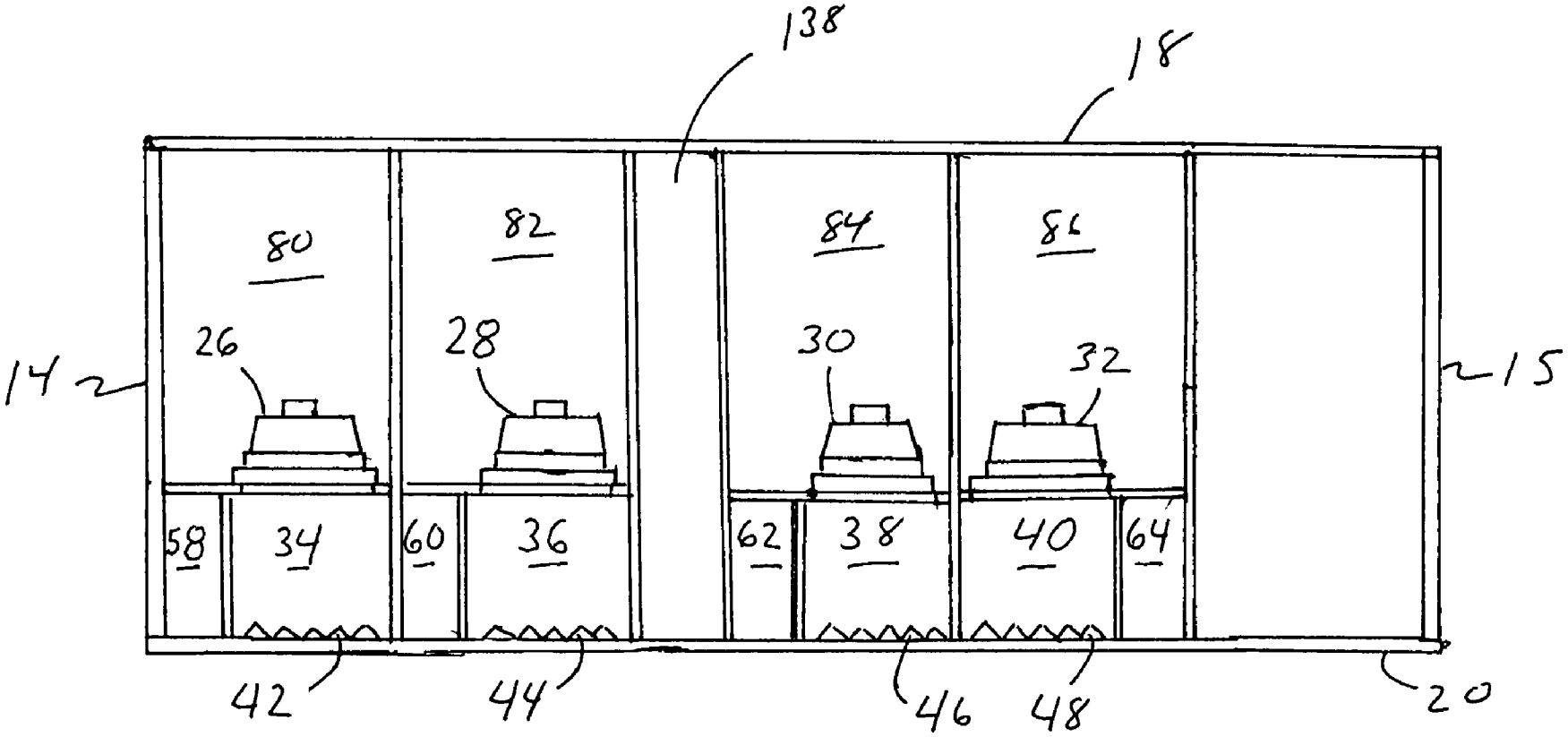
FIG. 4 is a cross sectional view of the loudspeaker enclosure of FIG. 1 taken along section line 4-4.
Figure 5:
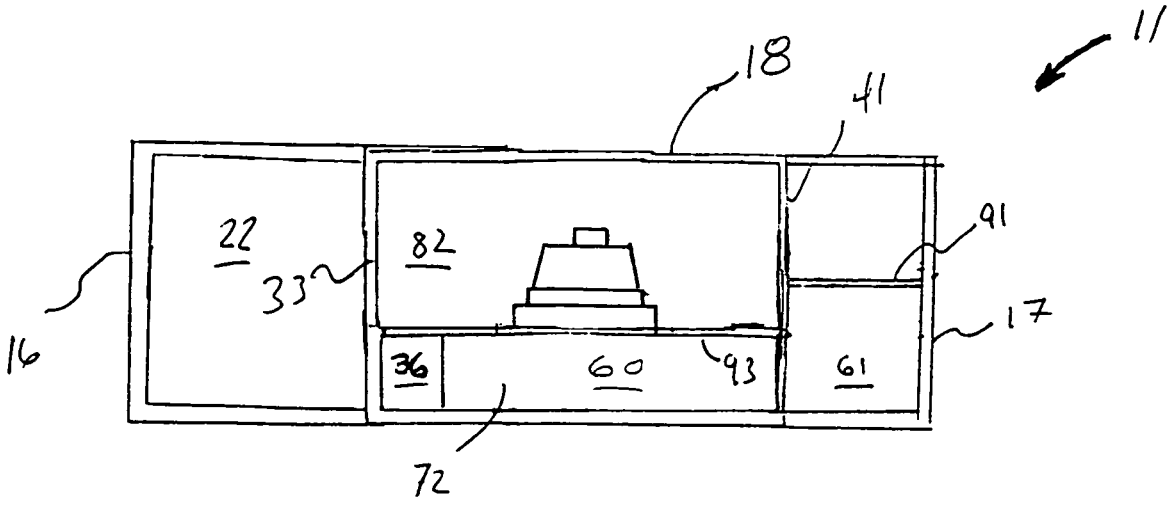
FIG. 5 is a cross section of a transducer housing taken along section line 5-5 in FIG. 3.

Referring to FIG. 4, which is a cross sectional view taken along section line 4-4 in FIGS. 1 and 2 and to FIG. 5, which is view taken into enclosure 11 along section line 5-5 in FIG. 4, the positioning of acoustic drivers 26, 28, 30, 32 over high pressure chambers 34, 36, 38 and 40 is illustrated. Acoustic drivers 26, 28, 30, 32 are housed in sealed back chambers 80, 82, 84 and 86, respectively. The term "sealed" as used here has its conventional meaning in the acoustical arts to mean that the back chambers have no acoustic outlet port. The only acoustic opening from sealed back chambers 80, 82, 84 and 86 are those directly in front of the diaphragms of acoustic drivers 26, 28, 30 and 32. Back chambers 80, 82, 84 and 86 slowly exchange air with their ambient environment, as is conventional. Other embodiments may make use of a port from the back chamber to the front chamber as described below.

Figure 6:
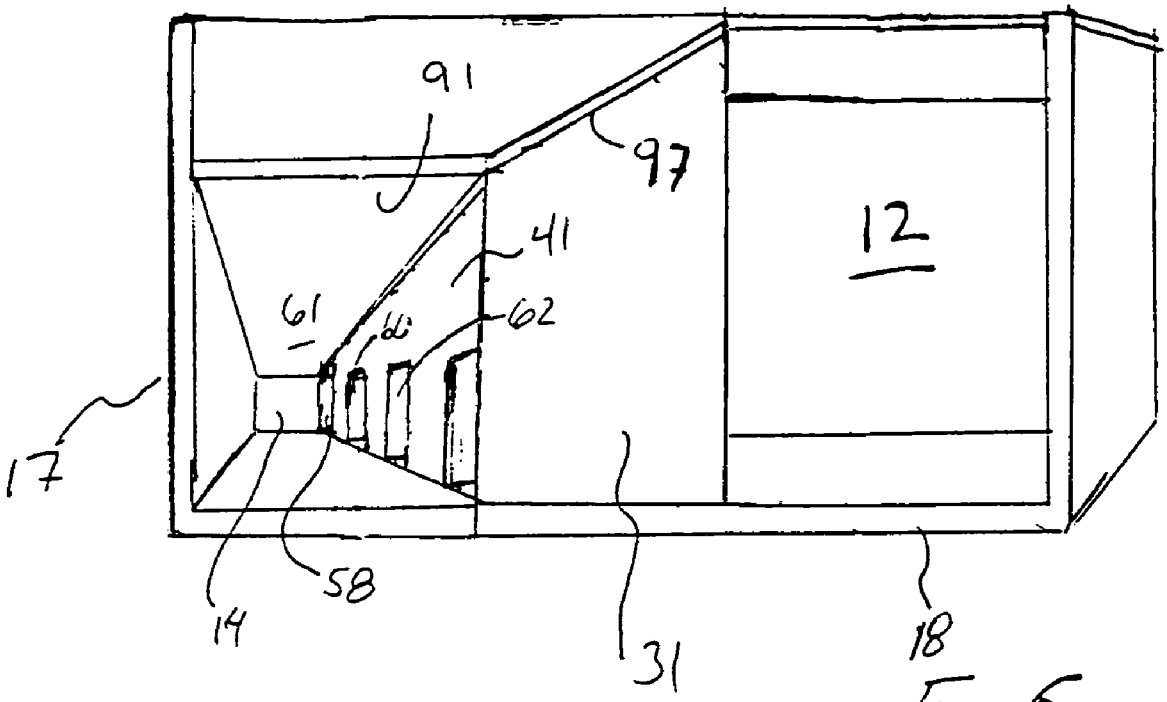
FIG. 6 is a rear elevation of the enclosure of FIG. 1 with the back panel of the enclosure removed.

In FIG. 5 the position of extended throat 60 adjacent and parallel to wall 72 illustrates the coupling mechanism for a representative high pressure chamber 36 through its extended throat 60 and further into summing throat 61. Because the upper cover section 91 is not horizontal, but slants upwardly from the base of summing throat 61 toward the back wall 15, the outlet from extended throats into summing throat 61 differs for each extended throat. Extended throat 60 includes some freeboard on wall 41 above the outlet and below upper cover section 91. As illustrated in FIG. 6 and described with reference to the figure below, the amount of freeboard for each port will differ. Acoustic driver 28 rests on a support plane 93. Sealed back chamber 82, like the remaining back chambers, is closed on one side by a planer wall 95.

Referring now to FIG. 6, which is an end view of enclosure 11 with back wall 15 removed, the interior of folded horn 22 is illustrated in greater detail, particularly the summing throat 61. Summing throat 61 is formed by portions of side wall 17, cover 91, base 18 and wall 41. Summing throat 61 collects sound output from the four throat extension sections 58, 60, 62, 64, the radiating outlets of which are visible along a side of summing section 61 defined by vertical wall 41. The surfaces forming summing throat 61 diverge from one another moving toward the back wall 15 from the base of the horn along front wall 14. The divergence of the upper and lower surfaces of folded horn 22 is provided in the upward slant of board 97. While the output port from extended throat 58 has a vertical extent substantially equal to the local height of summing throat 61, the outlets of downstream extended throats 60, 62 and 64, which are all of the same height, will have increasing amounts of freeboard, particularly in view of the increasing spacing between throats in the direction of acoustic propagation.

Any given horn has differing horizontal and polar frequency responses. And while a horn may operate well at certain frequencies its performance can degrade markedly at other frequencies. These changes in performance are highly dependent on the length of the horn. While each of transducers 26, 28, 30, 32 is coupled to the folded horn by an identical high pressure chamber and extended throat, the extended throats in 58, 60, 62 and 64 are coupled to summing junction 61 at points which are differently spaced from the mouth 12. In other words, horn 22 will have different performance characteristics for each transducer including a different optimal frequency operating range. Accordingly, each driver circuit differentially treats the signal applied to each transducer.

Producing sound of maximum intensity from loudspeaker system 10 requires that acoustic pressure waves from the outlets of extended throats be synchronized at the points where they merge. Due to the different distances sound travels to reach mouth 12 from the outlets from extended throats 58, 60, 62 and 64, the drive signal applied to transducers 26, 28, 30, 32 is time differentiated so that the sound waves constructively reinforce one another in summing section 61 rather than cancel or destructively interfere with one another. While the same signal is the genesis of the signal used to drive each of the four transducers 26, 28, 30, 32, this source signal must be processed differently before application to the respective transducers' voice coils to assure good phase matching at the mouth 12 and a good match of output from the extended throats 58, 60, 62 and 64 to the frequency response characteristic of folded horn 22 for a given outlet port from one of extended throats 58, 60, 62 and 64. The signal for the transducer associated with the throat radiating end removed by the greatest distance from mouth 12 is delayed least, while the signal driving the transducer associated with the throat radiating end closest to mouth 12 is delayed by the greatest period. Differences in impedance matching of the extended throat for each driver to summing section 61 require some band pass filtering and shading of the source signal for optimal system performance. The source signal may require dynamic phrase adjustment (i.e. adjustment of the signal phase as a function of frequency) of the source signal due to the frequency response characteristics of the horn which vary with frequency at each extended throat outlet port. Where the point of origin may be considered as having a 0 ms delay and straight phase settings, the acoustic driver 28 for a loudspeaker the previously given dimensions is driven with a delay of 1.77083 ms and a band limited phase adjustment to coincide arrival linearity with the point of origin. Similarly, acoustic driver 30 is driven with a 4.14583 ms delay and acoustic driver 32 is driven with a 7.6875 ms delay.

Figure 7:
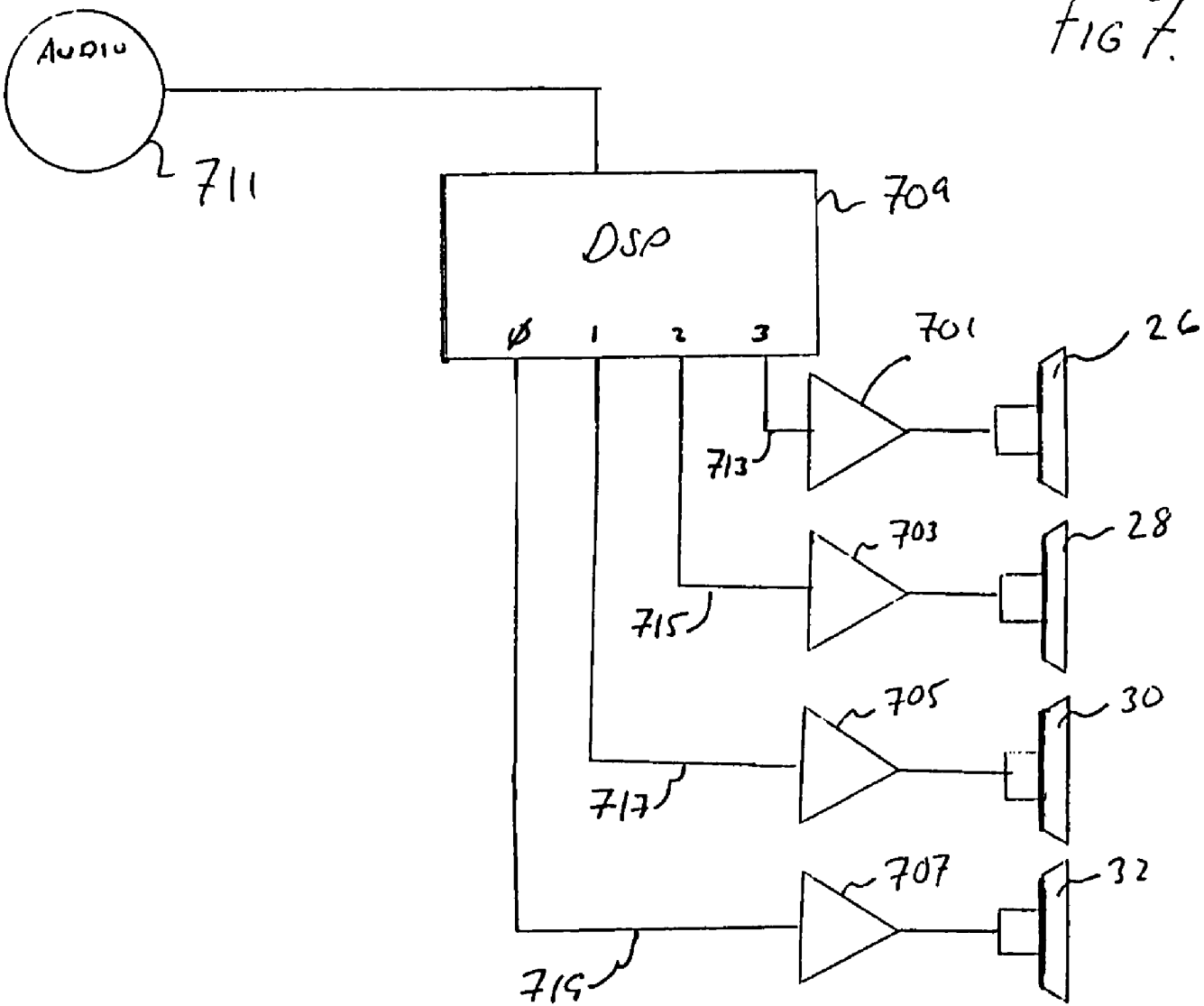
FIG. 7 is a block diagram schematic of drive circuitry for the loudspeaker.
Figure 8:
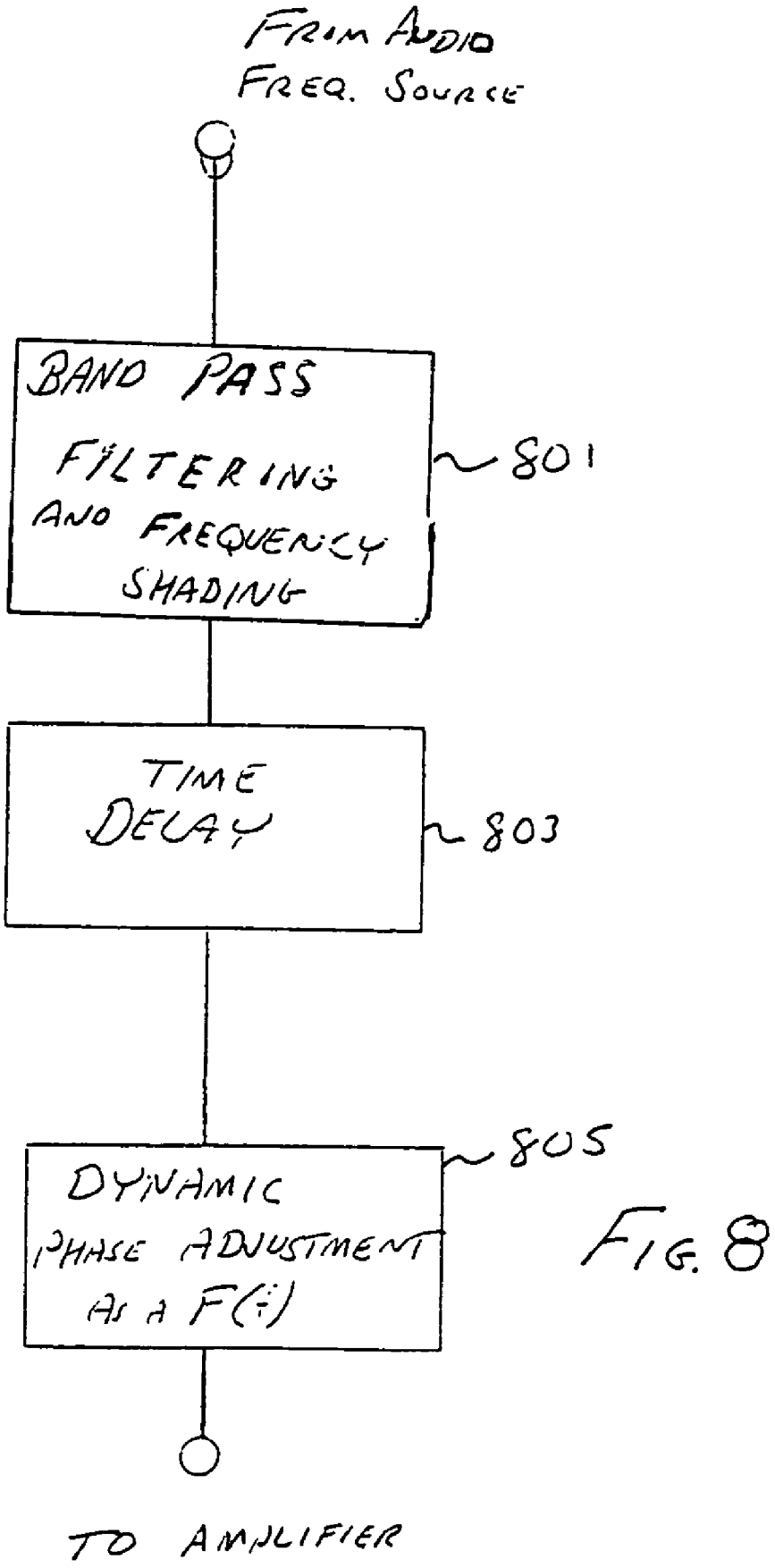
FIG. 8 is a block diagram schematic of the operation of the circuitry of FIG. 7.

Referring to FIGS. 7 and 8, a common source 711 of audio frequency signals is applied to four inputs of a digital signal processor (DSP) 709 which differentially processes the signals to accommodate the relative positions of acoustical drivers 26, 28, 30, 32. DSP 709 provides the four differentiated outputs on each of four channels 713, 715, 717, 719 to four amplifiers 701, 703, 705 and 707 associated with acoustical drivers 26, 28, 30, 32. In general, the input signal is processed in the same general way for all four channels, with only the parameters applied by the processing steps changing. For each channel, the signal is fed through a band pass filter 801 which passes frequency ranges best handled by a particular horn/driver configuration. Typically, the broadest band of frequencies is applied to the acoustic driver couple to the summing junction 61 at the furthest point from mouth 12. The roll off of the signal range applied to a driver may also be adjusted. Next, the filtered signal is applied to a time delay 803 which synchronizes the signals based on the differing distances of the speakers from the horn mouth. Lastly, the filtered, delayed signal for a channel is applied to a dynamic phase adjustment module 805, which adjusts the phase of the signal as a function of frequency. The specific parameters used will change along with changes in horn dimensions and the number of transducers used. DSP processing and discrete amplifier channels could be external of the horn module or reside internally allowing for easy in-field set-up as all internally required settings could be stored in each modular system for quick in-field set-up.

Figure 9:
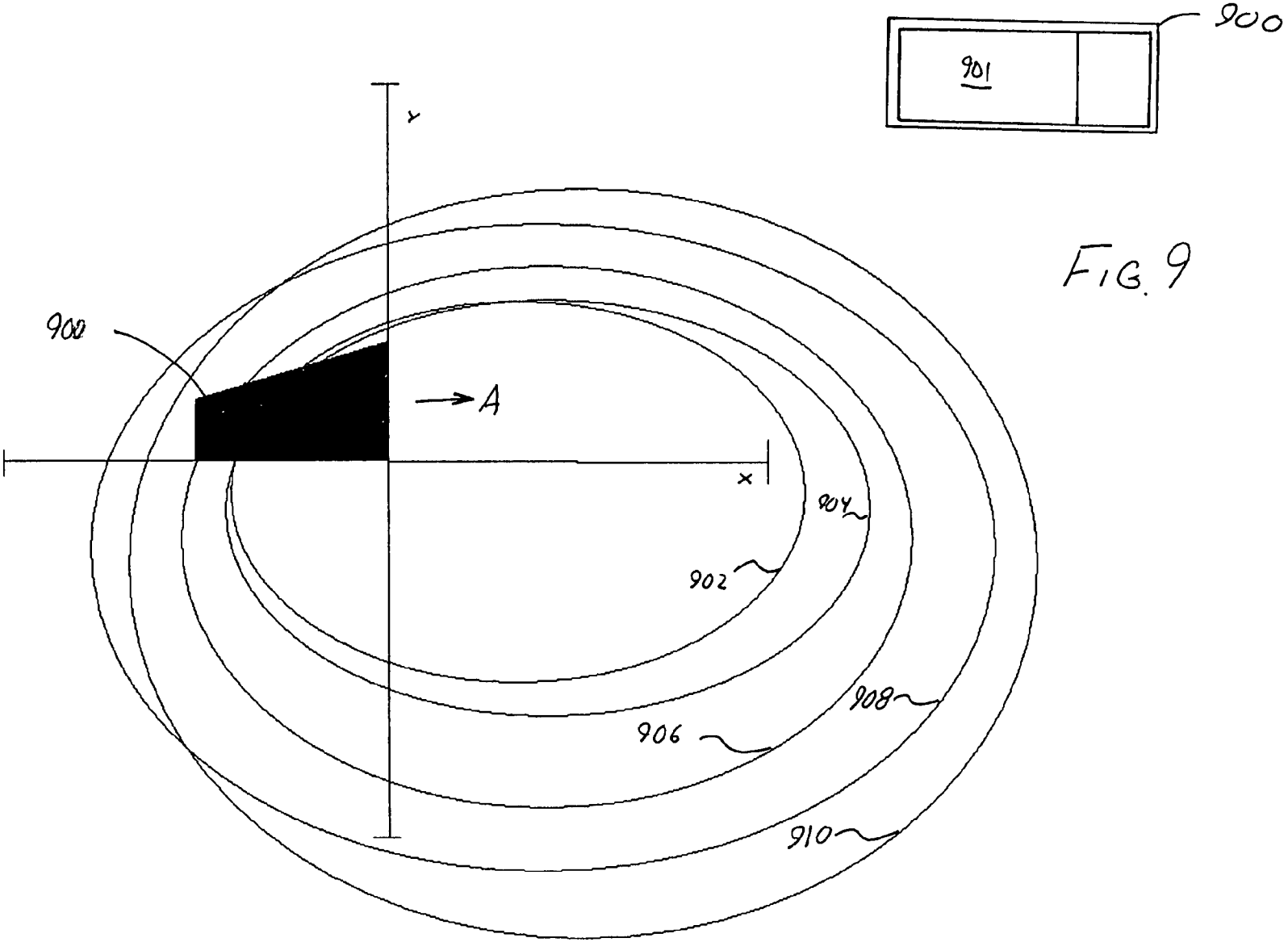
FIG. 9 is a directivity pattern for the loudspeaker of FIG. 1.

Referring to FIG. 9 the horizontal dispersion pattern for a single loudspeaker unit 900 positioned on the ground is illustrated. The arrow labeled "A" indicates the orientation of the loudspeaker mouth 901. The −6 dB lines 902, 904, 906, 908 and 910 for the frequencies 25, 35, 45, 65 and 90 Hz are shown. It may be seen that the dispersion pattern is hypercardiod but asymmetric.

Figure 10:
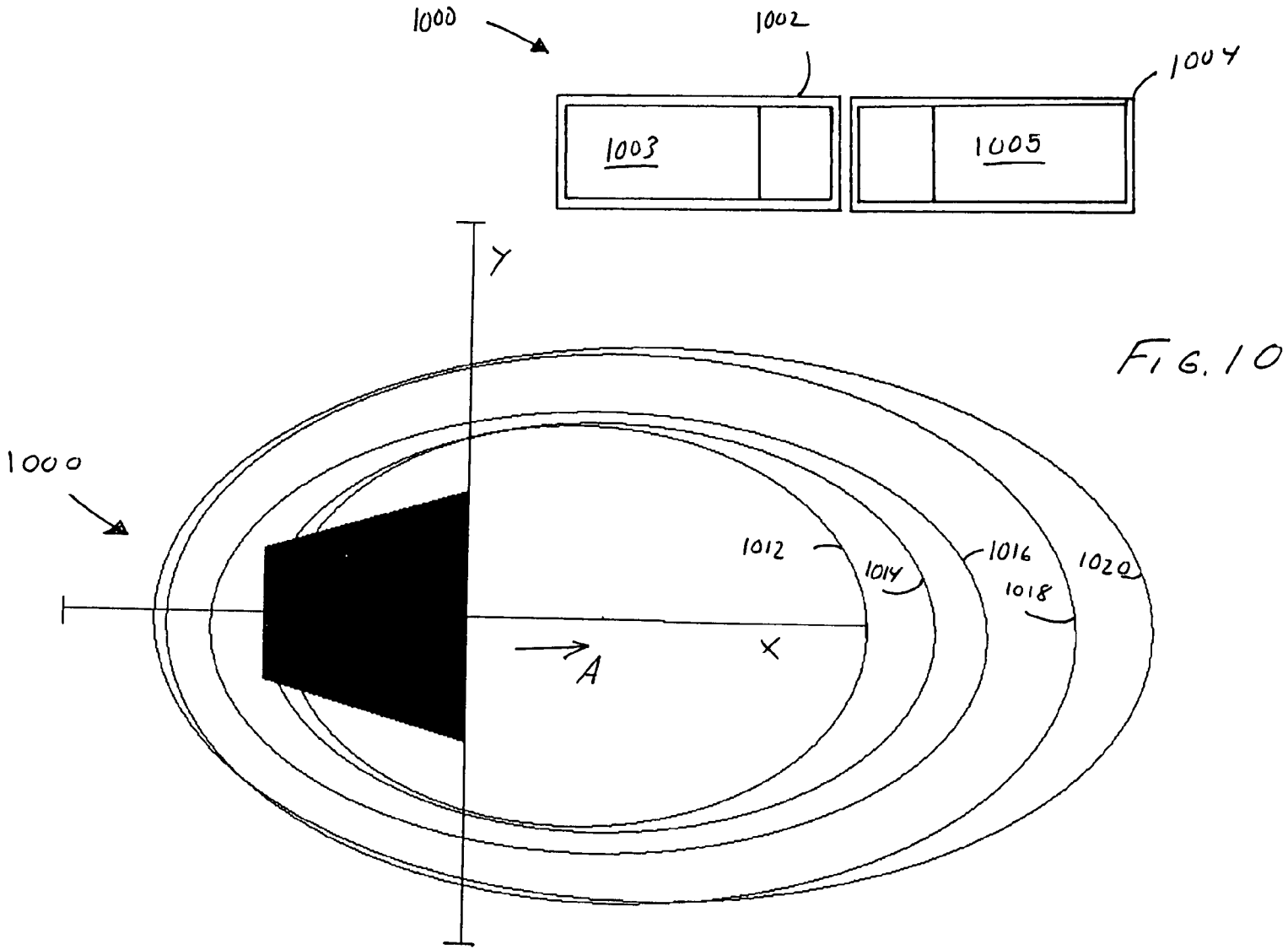
FIG. 10 is a directivity pattern for a two (horizontal) by one (vertical) array of loudspeakers.

Referring to FIG. 10 the horizontal dispersion pattern for a array 1000 comprising a pair of loudspeakers 1002, 1004 disposed in a two horizontal by one vertical arrangement is shown. The mouths 1003, 1004 of the loudspeakers are oriented in the array 1000 in the direction A to produce the symmetric dispersion pattern illustrated with −6 dB lines 1012, 1014, 1016, 1018 and 1020 for the same set of frequencies as above. The dispersion patterns are hypercardiod.

Figure 11:
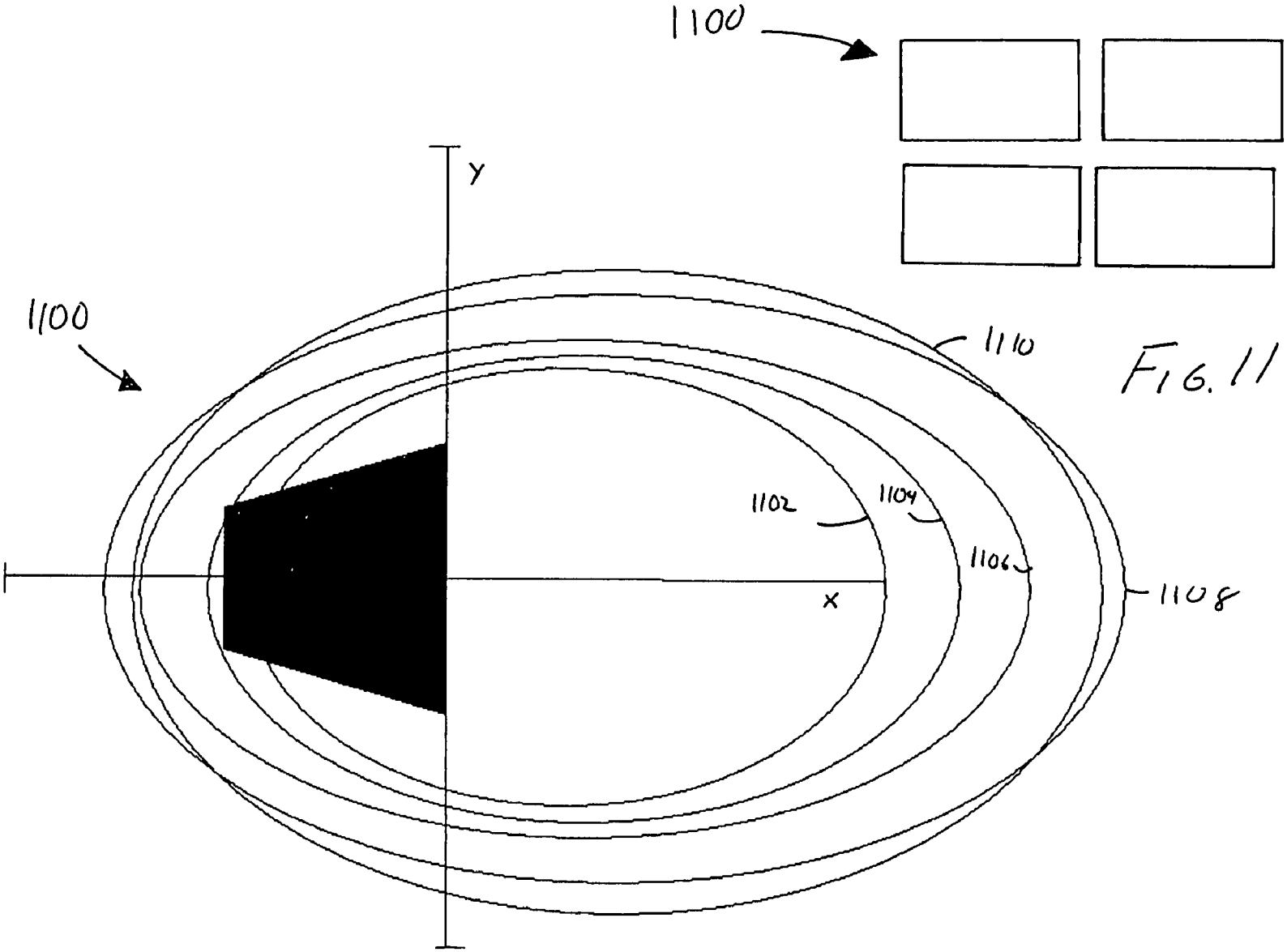
FIG. 11 is a directivity pattern for a two (horizontal) by two (vertical) array of loudspeakers.

Referring to FIG. 11 the horizontal dispersion pattern for a array 1100 comprising four loudspeakers disposed in a two horizontal by two vertical arrangement. A symmetric dispersion pattern illustrated with −6 dB lines 1102, 1104, 1106, 1108 and 1110 for the same set of frequencies as above. The dispersion patterns are hypercardiod and tighter than those for the two by one array.

Figure 12:
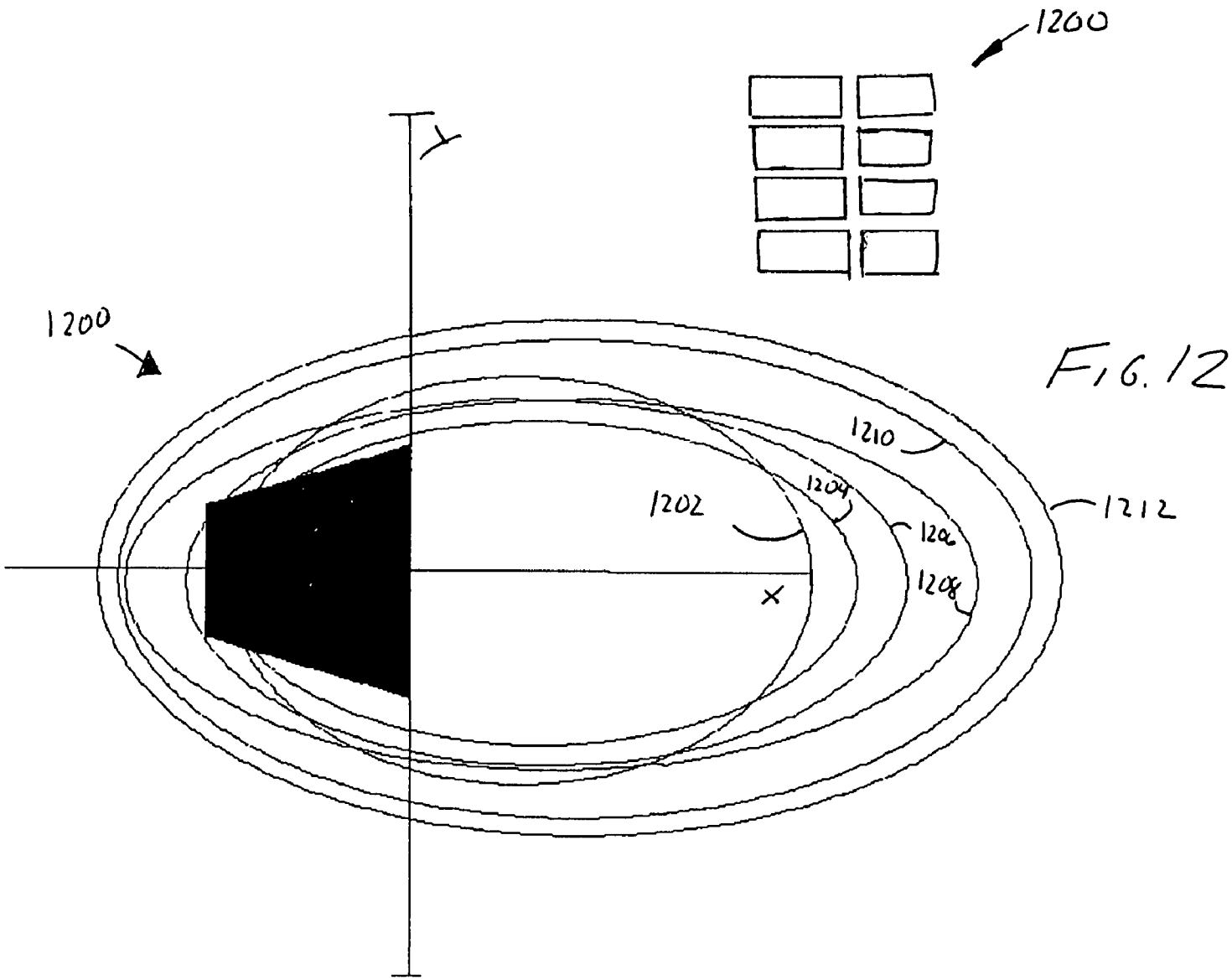
FIG. 12 is a directivity pattern for a four (horizontal) by two (vertical) array of loudspeakers.

Referring to FIG. 12 the horizontal dispersion pattern for a array 1100 comprising eight loudspeakers disposed in a two horizontal by four vertical arrangement. A symmetric dispersion pattern illustrated with −6 dB lines 1202, 1204, 1206, 1208 and 1210 for the same set of frequencies as above. The dispersion patterns are hypercardiod and tighter than those for the two by one array and the two by two array.

Figure 13:
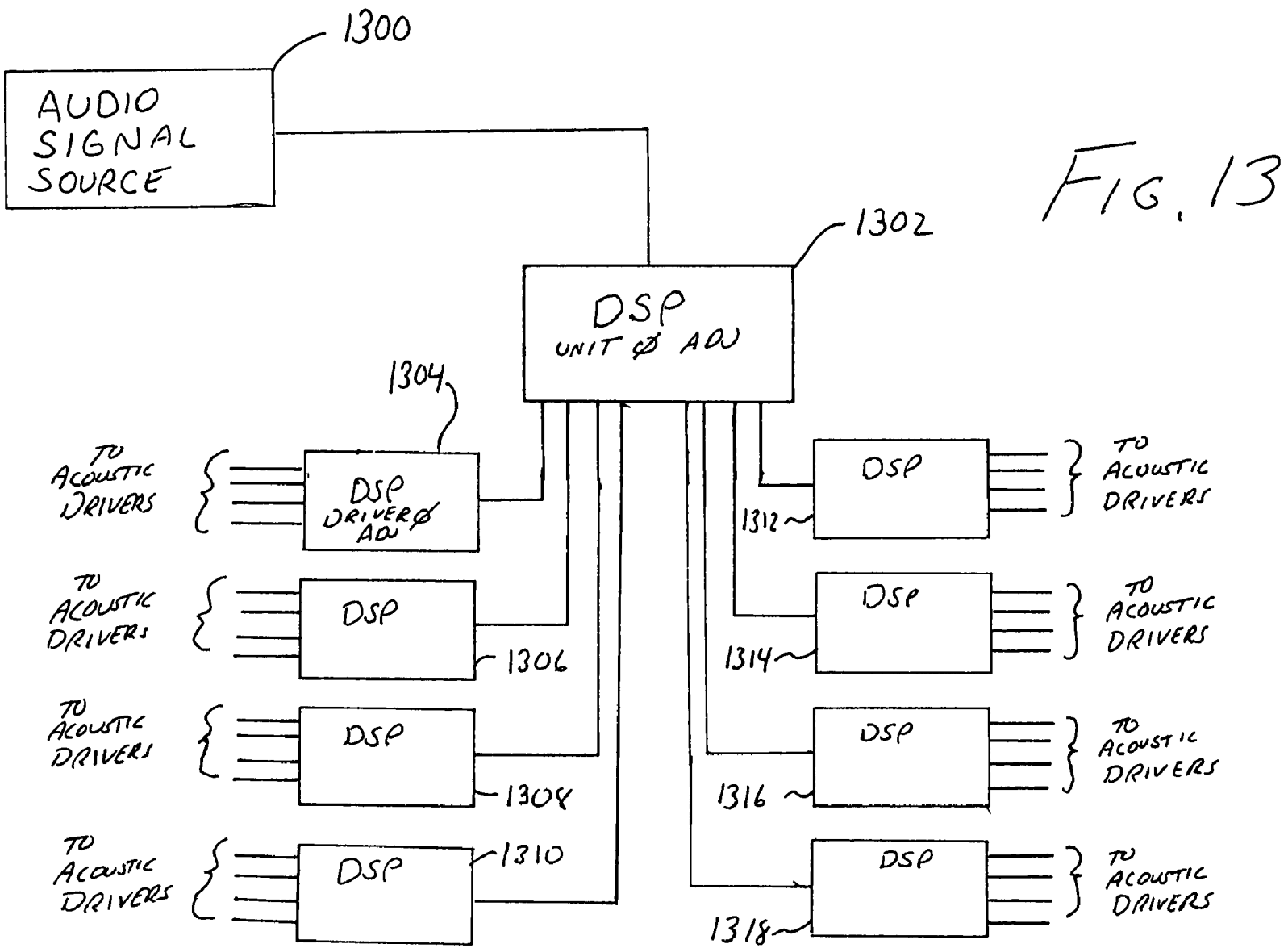
FIG. 13 is a block diagram schematic of drive circuitry for an array of loudspeakers providing directivity control.

Arrays of loudspeakers allow for introduction of steering focusing of the sound field generated by the coordinated operation of the individual units in the array. Steering focusing can be in both the vertical and the horizontal plane (provided that there is a plurality of loudspeakers both horizontally or vertically) and is done by varying phase and timing relationships between the loudspeaker units. Where the loudspeaker units are of the type disclosed in the present invention such phase and timing control DSP 1302 must be combined with the phase and timing control DSP 1304 exercised over the individual drivers in the loudspeaker units. Referring to FIG. 13 a block diagram schematic of a possible control arrangement is shown with an audio signal source 1300 providing a first digital signal processor (DSP) 1302 with an input signal which it splits eight ways to apply phase and timing, frequency processing to each of the loudspeakers in the four by two array 1200 illustrated in FIG. 12 to achieve sound field steering. Eight additional DSPs 1302-1318 provide phase/timing differentiation within a loudspeaker unit.

FIGS. 14-18 illustrate variations in installation of acoustic drivers and in coupling sound output from the drivers into the summing throat 61 of a series of enclosures 1411, 1511, 1611, 1711 and 1811. Enclosure 1411 illustrates a second order direct drive embodiment in which acoustic drivers 1426, 1428, 1430 and 1432 are set in sealed back chambers 1480, 1482, 1484 and 1486 and mounted to radiate through output ports (essentially shallow beveled edge throats) 1458, 1460, 1462 and 1464 directly into a summing throat 61. The distances d1, d2 and d3 between successive pairs of output ports could progressively increase.

Enclosure 1511 illustrates a second order isobaric configuration in which a first set of acoustic drivers 1526, 1528, 1530 and 1532 are set in sealed back chambers 1580, 1582, 1584 and 1586 and are mounted to radiate into front chambers 1581, 1583, 1585 and 1587 and into the obverse sides of a second set of acoustic drivers 1527, 1529, 1531 and 1533 which are directly ported through output ports (essentially shallow beveled edge throats) 1558, 1560, 1562 and 1564 directly into a summing throat 61. The volumes of the front chambers 1581, 1583, 1585 and 1587 are tuned. Enclosure 1511 tunes to a lower frequency than the embodiment of FIG. 14. The front and rear drivers for each port are synchronized.

Enclosure 1611 illustrates a another second order isobaric configuration in which a set of acoustic drivers 1626, 1628, 1630 and 1632 are set in sealed back chambers 1680, 1682, 1684 and 1686 and are mounted to radiate into front chambers 1681, 1683, 1685 and 1687 and into the obverse sides of a set of mass tuned passive radiating elements 1627, 1629, 1631 and 1633 which are directly ported through output ports (essentially shallow beveled edge throats) 1658, 1660, 1662 and 1664 directly into a summing throat 61. The volumes of the front chambers 1681, 1683, 1685 and 1687 are tuned. The masses of the passive radiators are readily adjusted to tune the loudspeaker.

Enclosure 1711 illustrates a fourth order bandpass configuration in which a set of acoustic drivers 1726, 1728, 1730 and 1732 are set in sealed back chambers 1780, 1782, 1784 and 1786 and are mounted to radiate into front chambers 1781, 1783, 1785 and 1787. The front chambers are ported through throats 1758, 1760, 1762 and 1764 directly into a summing throat 61.

Enclosure 1811 illustrates a sixth order bandpass configuration in which a set of acoustic drivers 1826, 1828, 1830 and 1832 are set in back chambers 1880, 1882, 1884 and 1886 and are mounted to radiate into front chambers 1881, 1883, 1885 and 1887. In addition, the back chambers are ported to the front chambers (1850, 1851, 1852 and 1853). The front chambers are ported through throats 1858, 1860, 1862 and 1864 directly into a summing throat 61. The rear chambers are tuned by volume and cascade ported to the front chambers.

Figure 19:
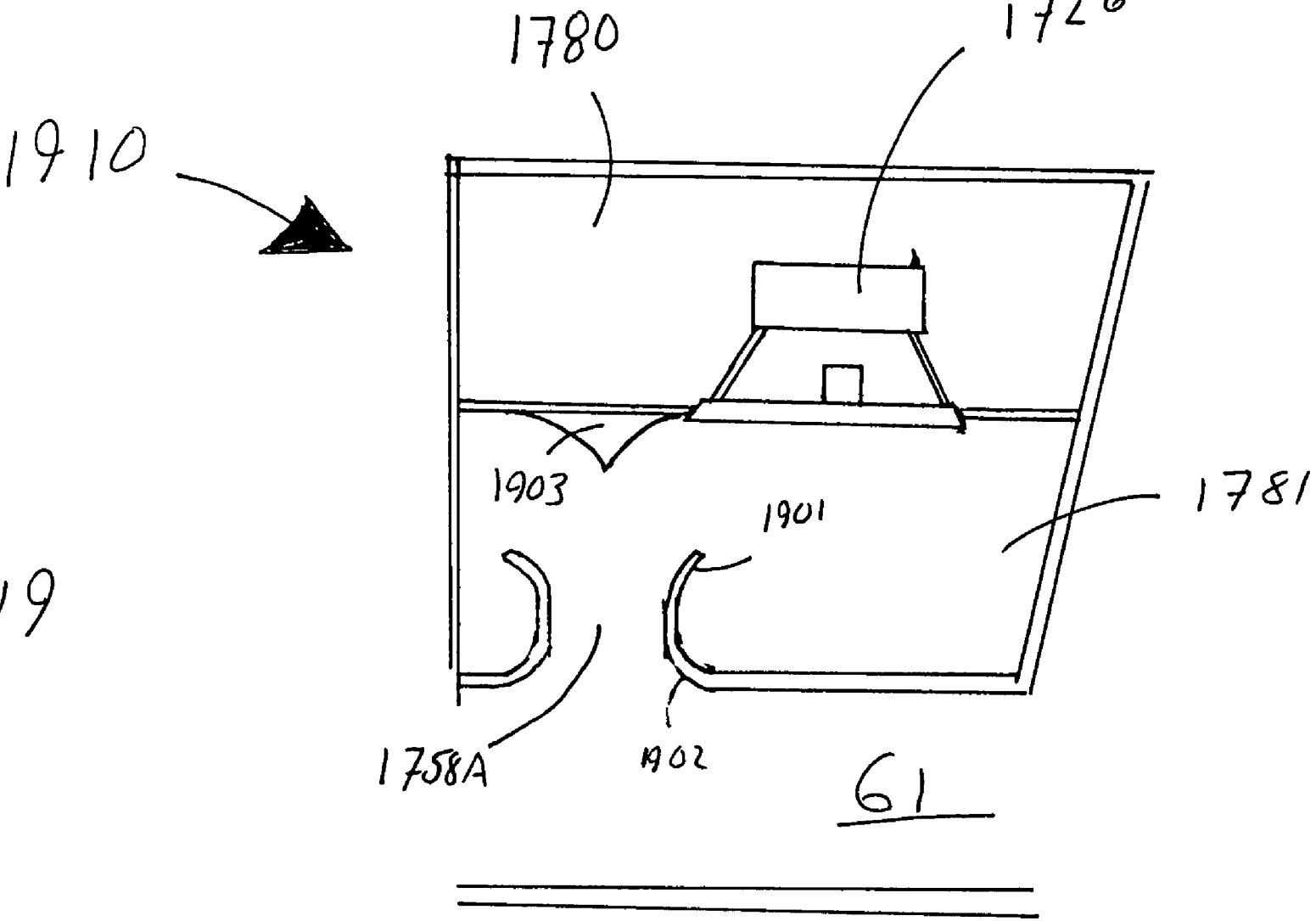
FIGS. 19-21 are schematic illustrations of laminar flow cells usable with the invention.
Figure 20:
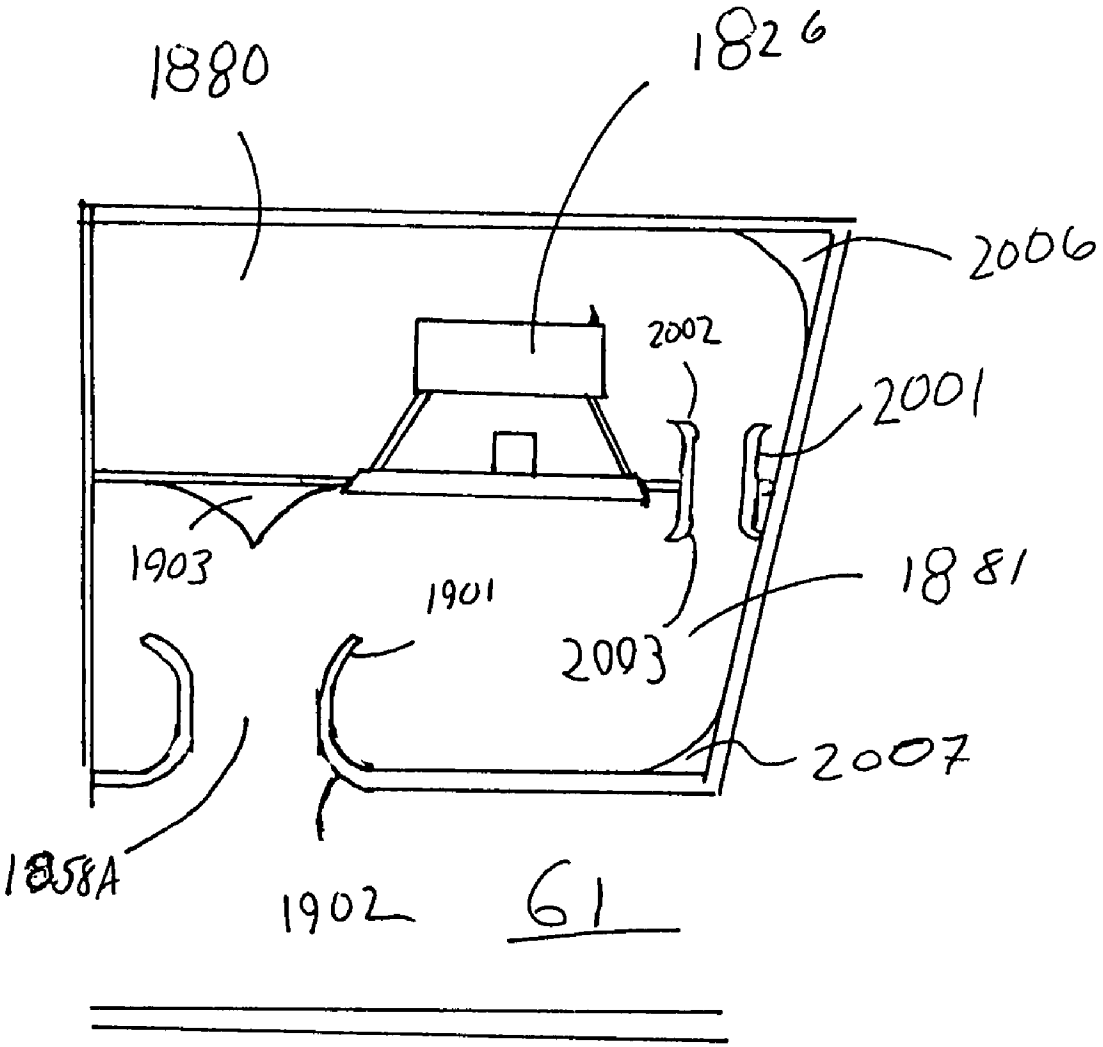

FIGS. 19 and 20 relate to improvements of the mounting enclosures used for a acoustic transducers within an enclosure to reduce turbulence, which is a contributor to harmonic distortions and to allow an increase in volume velocity. In FIG. 19 a acoustic transducer cell 1910, usable with enclosure 1711 modifies the outlet port from front chamber 1781 into summing throat 61 by providing an extended throat 1758A that has flared input and output ends 1901 and 1902. Extended throat 1758A is preferably cylindrical, but could be other shapes such as oval. Centered over the input end 1901 is a radial laminar flow diffuser 1903.

In FIG. 20 the output coupling from front chamber 1881 to summing throat 61 is identical to the arrangement provided from front chamber 1781 to summing throat 61. Here an extended port 2001 is provided from back chamber 1880 to front chamber 1881 having flared input and out ends 2002 and 2003. Radiused sections 2006 and 2007 in the front chamber and back chambers 1880 and 1881 are aligned on the input and output ends of port 2001 and serve to improve laminar flow.

Figure 21:
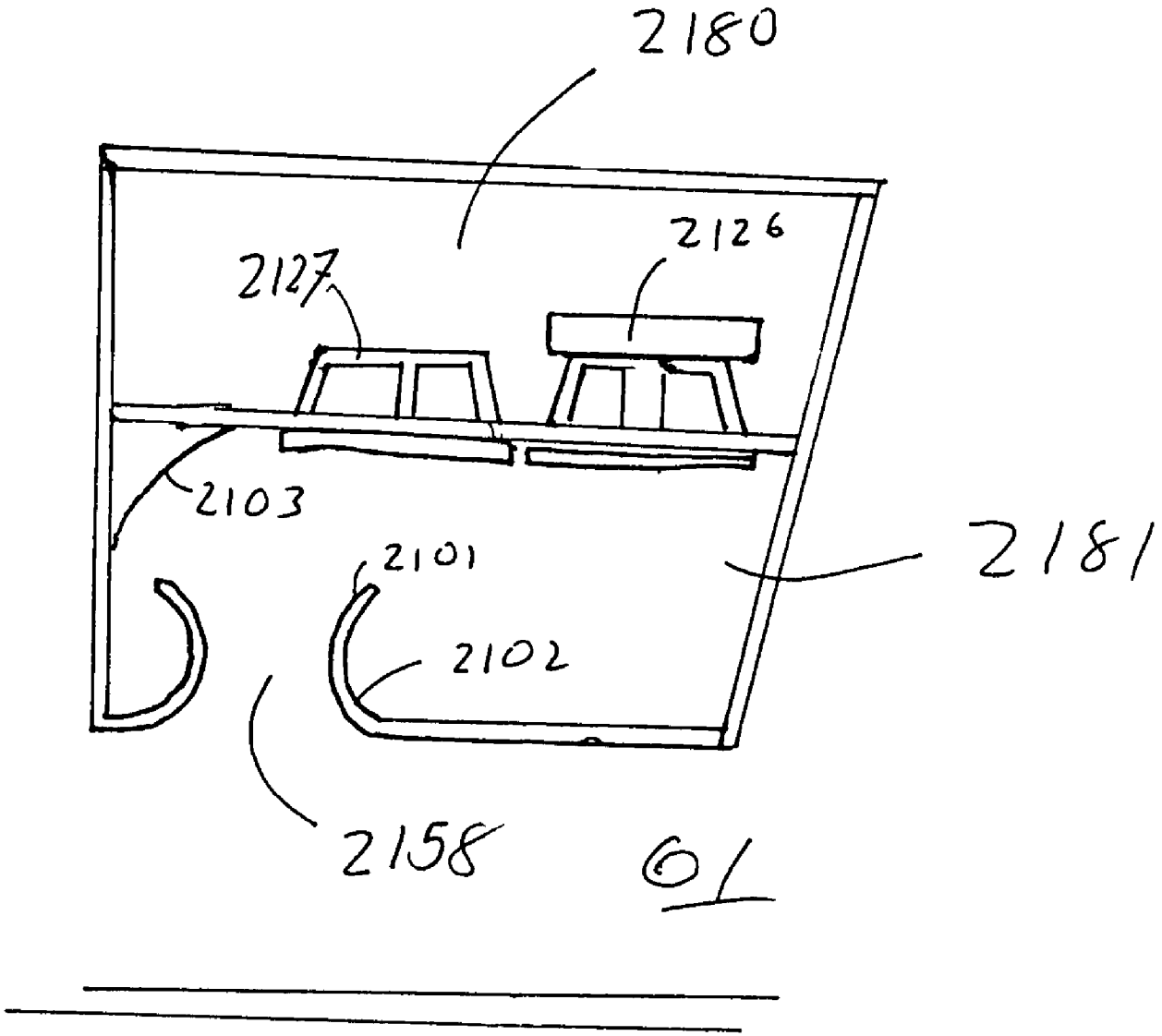

FIG. 21 illustrates a sixth order active/passive cell for inclusion in the horn enclosure of the present invention. Back chamber 2180 is a sealed, passively tuned chamber. This arrangement allows tuning the back chamber to a deeper frequency by adding mass to the diaphragm of passive radiator 2127 from back chamber 2180 to front chamber 2181. Active acoustic transducer 2126 is conventional. An extended port 2158 communicates from front chamber 2181 to summing throat 61. Input and output ends 2101 and 2102 of port/throat 2158 are flared and a radiused section 2103 enhance laminar flow.

The invention provides high acoustic output power for low frequency sound from a minimally sized, portable cabinet, suitable for use at outdoor, temporary or permanent venues.

While the invention is shown in only one of its forms, it is not thus limited but is susceptible to various changes and modifications without departing from the spirit and scope of the invention.

What is claimed is:

1. A loudspeaker comprising:

a horn having an elongated summing throat for input of sound energy and a mouth for radiating acoustic energy;

a plurality of discrete ports into the elongated summing throat for the input of sound energy with the discrete ports into the summing throat being spaced lengthwise along the elongated summing throat in order, with the spacing between successive pairs of discrete ports growing progressively larger in the acoustic direction of the mouth along the elongated summing throat; and an acoustic transducer arrangement for each of the plurality of discrete ports, the acoustic transducer arrangements each including a driver suitable for operation over a common frequency range for inserting sound energy into each of the plurality of discrete ports with the sound energy timed for constructive reinforcement of sound energy in the summing throat.

2. A loudspeaker as set forth in claim 1, wherein the acoustic transducer arrangement includes an acoustic driver set in a sealed back chamber and oriented to radiate into a front chamber with an extended port connecting the front chamber to the summing throat via one of the discrete ports.

3. A loudspeaker as set forth in claim 1, wherein the acoustic transducer arrangement includes an acoustic driver set in a sealed back chamber and oriented to radiate into a front chamber and the back of a second acoustic driver, the front of the second acoustic driver being mounted to radiate through a discrete port into the summing throat.

4. A loudspeaker as set forth in claim 1, wherein the acoustic transducer arrangement includes an acoustic driver set in a sealed back chamber and oriented to radiate into a front chamber and into a mass loaded passive radiator, with the mass loaded passive radiator set over a discrete port to reradiate sound into the summing throat.

5. A loudspeaker as set forth in claim 1, wherein the acoustic transducer arrangement includes an acoustic driver set in a ported back chamber and oriented to radiate into a front chamber with a port connecting the back to the front chamber and an extended port connecting the front chamber to the summing throat via one or both of the discrete ports.

6. A loudspeaker as set forth in claim 1, further comprising transducer drive signal processing circuitry including:

a band pass filter receiving the acoustic range signal and producing a filtered signal therefrom;

the time delay element receiving filtered signal and producing a delayed, filtered signal; and a dynamic phase adjustment element receiving the delayed, filtered signal and adjusting the phase of the signal as a function of frequency to produce a drive signal for an acoustic transducer.

7. A loudspeaker as set forth in claim 6, wherein the band pass filters, delay elements and dynamic phase adjustment elements are realized in a digital signal processor.

8. A loudspeaker as set forth in claim 1, further comprising:

the horn being a folded horn.

9. A loudspeaker as set forth in claim 1, the acoustic transducer arrangement being a laminar flow cell.

10. A loudspeaker as set forth in claim 9, the laminar flow cell including:

a sealed back chamber, a front chamber ported to the summing throat; and an active transducer set between the sealed back chamber and the front chamber.

11. A loudspeaker as set forth in claim 10, the laminar flow cell further including:

a passive radiator set between the sealed back chamber and the front chamber.

12. A loudspeaker as set forth in claim 9, the laminar flow cell further including:

a front chamber ported to the summing throat;

a back chamber ported to the front chamber; and an active transducer set between the back and front chambers.

13. A horn loaded loudspeaker comprising:

a plurality of acoustic drivers suitable for operation over a common frequency range;

a plurality of closed box baffles with each of the plurality of acoustic drivers mounted in one of the plurality of closed box baffles;

a plurality of high pressure chambers with each of the plurality of acoustic drivers oriented to radiate into one of the plurality of high pressure chambers or high pressure throats;

a plurality of elongated ports, including one for each of the plurality of high pressure chambers, coupling the plurality of high pressure chambers via outlets to the horn;

a summing throat portion of the horn into which the outlets from the elongated ports open, the summing throat being elongated in a direction of acoustic propagation toward the horn mouth and with the outlets being distributed along the summing throat in its direction of elongation, the spacing between successive adjacent pairs of outlets into the summing throat being progressively larger in the acoustic direction of the mouth.

14. A horn loaded loudspeaker as set forth in claim 13 having a summing throat portion of the horn along which are spaced in the direction of acoustic propagation a plurality of at least three sound inlet ports with the spacing between each successive pair of inlet ports increasing in the direction of acoustic propagation.

15. A horn load loudspeaker as set forth in claim 14, further comprising an acoustic transducer for each sound inlet port, and acoustic transducer energization circuitry located either internal or external the horn module for varying the phase of a drive signal applied to each acoustic transducer so that sound generated by the respective acoustic transducer arrives via its respective inlet port at the summing throat timed to reinforce the sound wave propagating through the summing throat.

* * * * *